US006389630B1

(12) United States Patent
Chen

(10) Patent No.: US 6,389,630 B1
(45) Date of Patent: May 21, 2002

(54) T-SHAPED HANDLE WITH CENTRAL ACTUATOR AND SAFETY MECHANISM FOR FLOOR POLISHING MACHINE

(75) Inventor: Simon Chen, Los Angeles, CA (US)

(73) Assignee: Viper Industrial (Hong Kong) Ltd., Chaiwan (HK)

( * ) Notice: Subject to any disclaimer, the term of this patent is extended or adjusted under 35 U.S.C. 154(b) by 0 days.

(21) Appl. No.: 09/865,373

(22) Filed: May 24, 2001

Related U.S. Application Data

(63) Continuation of application No. 09/844,758, filed on Apr. 26, 2001.

(51) Int. Cl.[7] ..... A47L 11/162
(52) U.S. Cl. ..... 15/49.1; 15/50.1; 15/DIG. 10
(58) Field of Search ..... 15/49.1, 50.1, 15/DIG. 10

(56) References Cited

U.S. PATENT DOCUMENTS 3,153,251 A * 10/1964 Ohlson
3,411,170 A * 11/1968 Kingsley
4,174,473 A * 11/1979 Brenneman
4,198,721 A * 4/1980 Copeland
4,365,377 A 12/1982 Todd et al. ..... 15/98
4,435,870 A * 3/1984 Tucker et al.
4,542,551 A * 9/1985 Phillips
4,900,881 A * 2/1990 Fischer
D333,018 S 2/1993 Bothun et al. ..... D32/19
5,261,140 A * 11/1993 Szymanski

* cited by examiner

*Primary Examiner*—Terrance R. Till
(74) *Attorney, Agent, or Firm*—Sheridan Ross P.C.

(57) ABSTRACT

A handle for an electric floor polishing or burnishing machine comprising a centrally-mounted actuator with safety lock is disclosed. In one embodiment, the handle is generally T-shaped and has a centrally-mounted actuator, which offers an operator more control over the polisher or burnisher and allows for one-handed operation. In another embodiment, the handle also has a safety lock which prevents the accidental operation of the machine.

24 Claims, 7 Drawing Sheets

T-SHAPED HANDLE WITH CENTRAL ACTUATOR AND SAFETY MECHANISM FOR FLOOR POLISHING MACHINE

This is a continuation of U.S. patent application Ser. No. 09/844,758 filed Apr. 26, 2001. The entire disclosure of the aforementioned application is incorporated herein by reference.

FIELD OF THE INVENTION

The present invention relates to the field of floor polishers and burnishers, and, more particularly, to a T-shaped handle for a floor polisher or burnisher with a centrally mounted actuator bail and safety mechanism.

BACKGROUND OF THE INVENTION

Floor polishers, and particularly those electrically operated, have been used for many years. Typically, a polisher unit has an operator's handle angularly extending upward (e.g., approximately 45 degrees) from a housing, which encloses the motor and supports a polishing head (e.g., a circular pad or brush among other components). The polishing head is typically round, moves in a circular motion and is in direct contact with the floor. Generally, a polisher rotates at a slow speed, such as 150–1000 rpms. Due to the slow rotational speed, the polisher cannot easily be moved in forward and reverse directions during operation. Instead, an operator typically moves the device in a left to right manner. Thus, while other shaped handles are available (e.g., an inverted U-shape found on most modern gasoline push-type lawnmowers), it is advantageous to use a T-shaped handle to better direct major left and right movements of the polisher.

A T-shaped handle typically consists of a left and a right arm with one corresponding actuator (e.g., a bail) on each arm. An operator can usually activate the unit by depressing the left bail with his left hand or depressing the right bail with his right hand. Units may require continuous depression of either the left or right bail to operate the machine or may employ a locking mechanism, which allows a bail to remain depressed until it is released.

A problem exists, however, for operators that use these types of polishers. It is not uncommon for the electrical cord of the polisher to get in the way of the polishing head during unit operation. Accordingly, an operator must be aware of the location of the cord at all times. Any contact between the cord and polishing hand could damage the cord's integrity and expose the polisher to risk of an electrical short, thereby jeopardizing operation of the machine and the safety of its operator. In order to combat this problem, an operator will typically use one hand to depress the bail and steer the direction of the machine while using the other hand to keep the cord out of harm's way. Unfortunately, this method of operating the unit is troublesome for the operator because it requires forearm and wrist strength to maintain the direction of the unit, using a single hand, due to the force generated from the unit's polishing head rotating over the floor. Since the left and right arms of the handle are not in line with the axis of the rotating head, if an equal amount of resistance is not applied to the handle to counteract this force, the unit will tend to drift to one side or the other. Such uncontrollable movement of the polisher can cause damage to the surrounding environment (e.g., furniture or walls in a room). Thus, the closer the operator can grip the unit to the center of the handle, the easier it will be for him or her to direct the polisher with one hand while keeping the cord out of harm's way with the other hand. There is a need for a T-shaped handle which an operator can more easily control and direct with one hand.

A polisher operator also faces the safety issue of having the polisher accidentally activated. Thus, there is a need for a safety mechanism to be incorporated into the T-shaped handle of a polisher. The safety mechanism must be readily accessible by the operator and easily deployed. It should prevent an individual from inadvertently depressing any one of the actuators, thereby eliminating any risk associated with accidentally engaging the polisher at an inopportune moment. On the other hand, the safety mechanism must allow the operator to intentionally disengage it so that the polisher can be used. Thus, there is a need for a safety mechanism, which is conveniently mounted on a T-shaped handle, is easily deployed by an operator, prevents the accidental operation of the polisher, and becomes disengaged when necessary in order to operate the unit. These same problems exist for burnisher operation. Consequently, the term polisher as used throughout this Patent is intended to include a polisher and/or a burnisher or like cleaning machine.

SUMMARY OF THE INVENTION

The present invention is designed to overcome the aforementioned problems and meet the aforementioned, and other, needs. It is thus one object of the present invention to provide a T-shaped handle for a polisher or a burnisher with three areas to grip the handle—a left arm, a right arm, and a central opening, each with its own actuator. This alignment gives the operator the greatest flexibility in directing the unit with one hand, leaving the other hand free to attend to other concerns, such as the electrical cord.

Another object of this invention is to provide a T-shaped handle for a polisher or burnisher with an integrated safety mechanism, which is easily deployed with one hand and which prevents the accidental operation of the machine.

In one embodiment of the present invention, a T-shaped handle for a floor polisher or burnisher having an electric motor, is provided, comprising:

(a) a means for controlling a supply of electricity to the motor; and (b) a first means for actuating the means for controlling the supply of electricity to the motor, wherein the first actuating means is centrally mounted on the T-shaped handle.

The present invention offers an alternative to traditional T-shaped polisher or burnisher handles by incorporating a third, centrally located, actuator with a conveniently positioned and easily deployable safety lock. Now, an operator can more easily direct and operate a polisher or burnisher without the concern of accidental engagement or the other problems discussed above.

Figure 1:
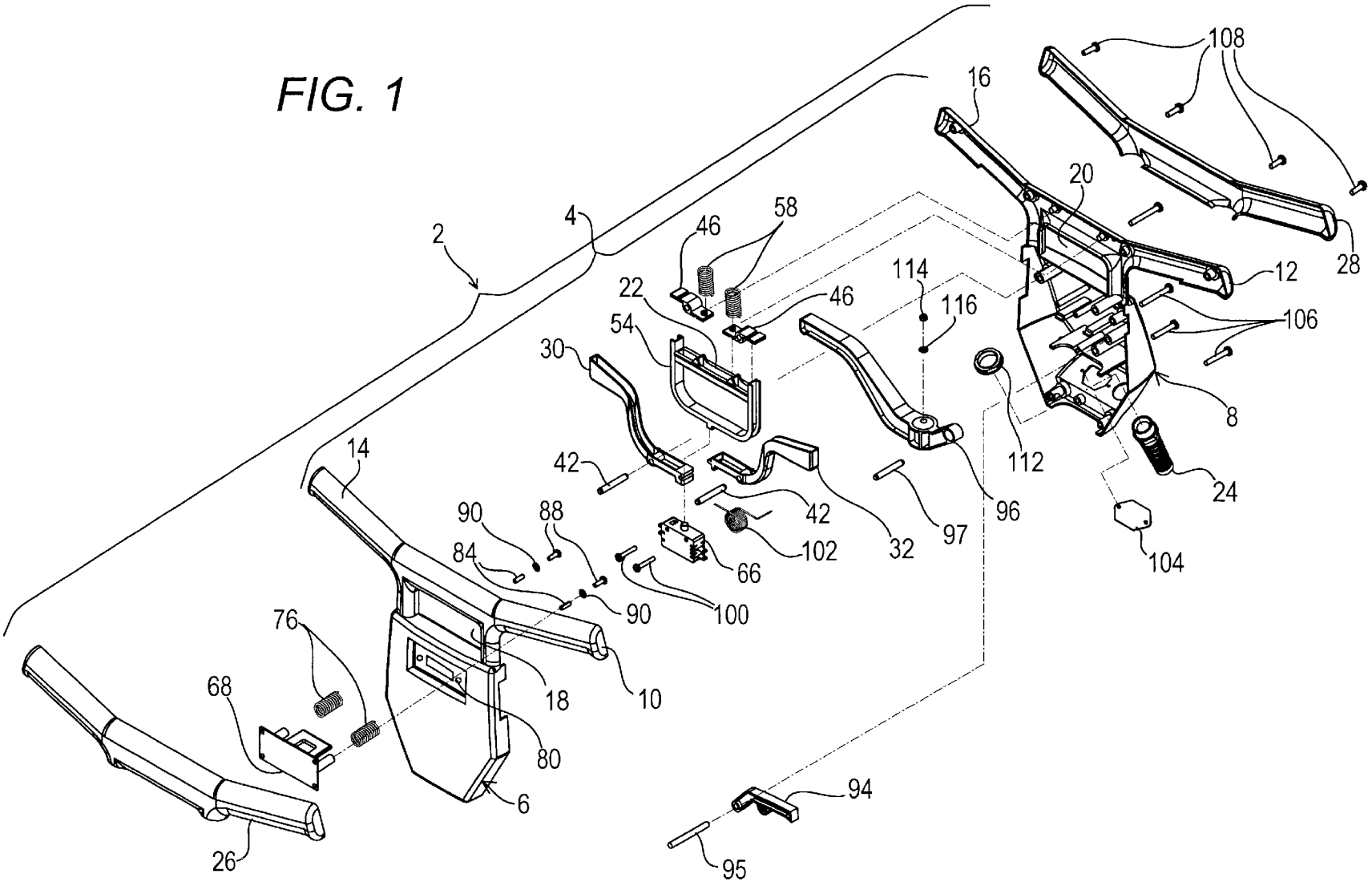
FIG. 1 is an exploded perspective view of the handle.

The following components and numbers associated thereto are shown in the drawings and provided here for ease of reference:

| # | Component |
|---|---|
| 2 | Handle |
| 4 | Housing |
| 6 | Front housing |
| 8 | Rear housing |
| 10 | Left arm of front housing |
| 12 | Right arm of rear housing |
| 14 | Right arm of front housing |
| 16 | Left arm of rear housing |
| 18 | Aperture in front housing |
| 20 | Aperture in rear housing |
| 22 | Center actuator |
| 24 | Pigtail connector |
| 26 | Front cover |
| 28 | Rear cover |
| 30 | Left actuator |
| 32 | Right actuator |
| 34 | First end of left actuator |
| 36 | Second end of left actuator |
| 38 | Second end of right actuator |
| 40 | Pivot stand |
| 42 | Pin |
| 44 | First end of right actuator |
| 46 | Trans-bail |
| 48 | Trans-bail pivot stand |
| 50 | First end of trans-bail |
| 52 | Second end of trans-bail |
| 54 | U-shaped trans-bail |
| 56 | Trans-bail stand |
| 58 | Spring |
| 60 | Spring receiver |
| 64 | Interconnection point of left and right actuators |
| 66 | Switch |
| 68 | Safety lock |
| 70 | Face plate |
| 72 | L-shaped protrusion of safety lock |
| 74 | Cylindrical receiving tube of safety lock |
| 76 | Spring |
| 78 | Front side of front housing |
| 80 | Safety lock depression |
| 82 | Rear side of front housing |
| 84 | Tube |
| 86 | Rear of safety lock depression |
| 88 | Bolt |
| 90 | Washer |
| 92 | Front side of rear housing |
| 94 | Solution dispensing lever |
| 95 | Pin |
| 96 | Height adjustment lever |
| 97 | Pin |
| 98 | Circuit breaker |
| 100 | Bolt |
| 102 | Spring |
| 104 | Socket cover |
| 106 | Bolt |

-continued

| # | Component |
|---|---|
| 108 | Bolt |
| 110 | Rear side of rear housing |
| 112 | Lock nut |
| 114 | Nut |
| 116 | Washer |
| 118 | Fastening apertures |

DETAILED DESCRIPTION OF THE PREFERRED EMBODIMENT

While this invention is susceptible of embodiments in many different forms, there are, as shown in the drawings and will herein be described in detail, preferred embodiments of the invention. The reader is to understand that the present disclosure is to be considered as an exemplification of the principles of the invention and is not intended to limit the broad aspects of the invention to the embodiments illustrated.

The present invention recognizes that the limited nature of traditional T-shaped handles for floor polishers and burnishers and offers a solution to the difficulty of operating these units with one hand. The present invention also recognizes the risk of accidental engagement of the unit. Thus, the present invention presents an improvement to the traditional T-shaped floor polisher handle.

Figure 2:
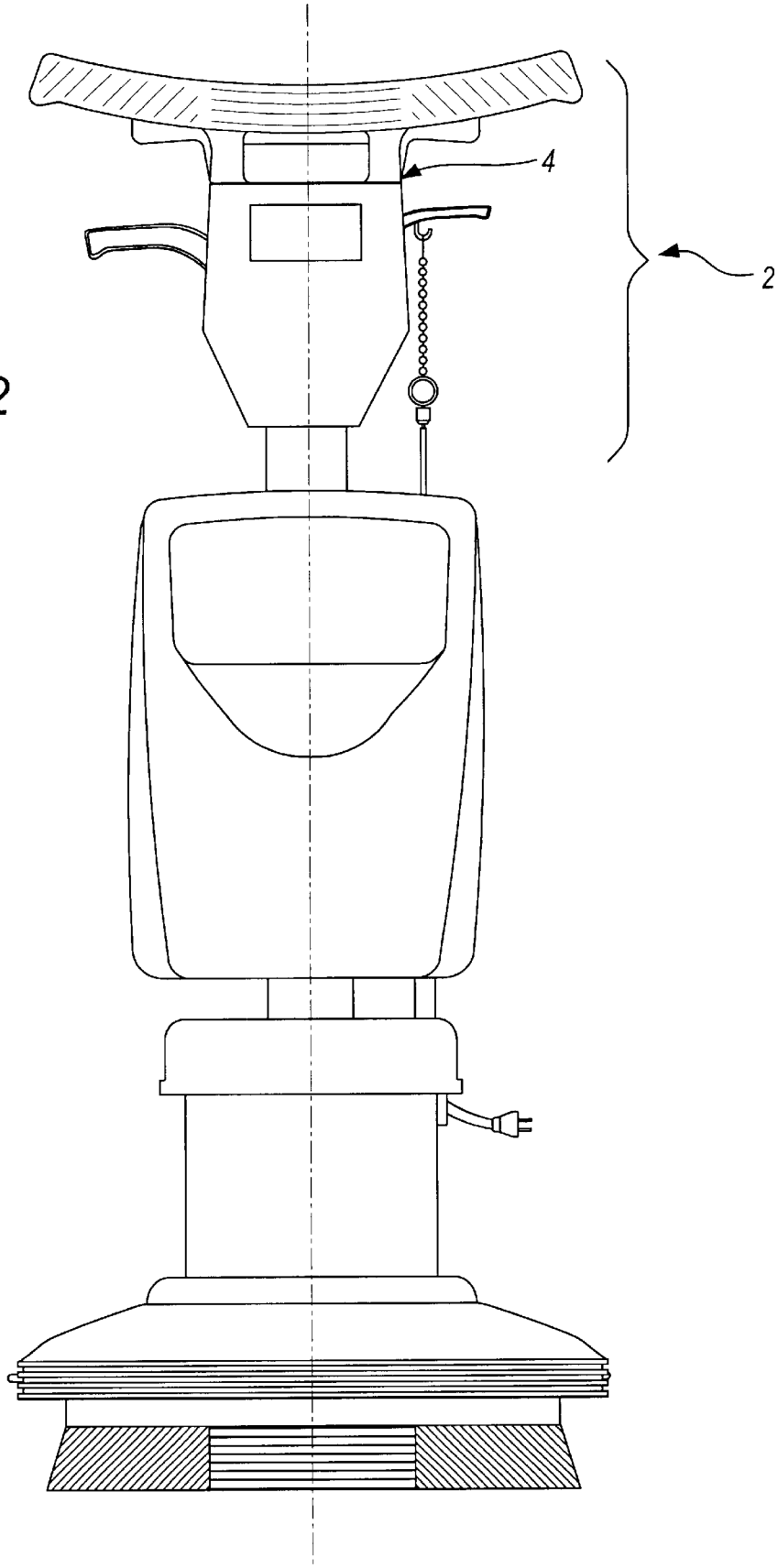
FIG. 2 is a front perspective view of the handle as mounted on a floor polishing machine.

FIG. 1 is an exploded perspective view of the innovative floor polisher handle. FIG. 2 is a front perspective view of the handle 2 as mounted on a floor polishing machine. As shown in FIG. 2, the handle 2 is generally comprised of housing 4. Referring back to FIG. 1, in the preferred embodiment, the housing 4 is comprised of a front housing 6 and a rear housing 8, which are generally T-shaped. The front housing 6 and rear housing 8 are identical in their outlining shapes so that they can be fastened together. It is preferable that the front housing 6 and rear housing 8 each have a left arm and a right arm. The left arm of the front housing 10 is the mirror image of the right arm of the rear housing 12 so that they can be fastened together. Likewise, the right arm of the front housing 14 can be identical in shape to the left arm of the rear housing 16. The front housing 6 has an aperture 18 centered beneath the left arm 10 and right arm 14. Similarly, the rear housing 8 has a duplicate aperture 20 centered beneath its respective left arm 16 and right arm 12. When the front housing 6 and rear housing 8 are fastened together, the respective apertures (i.e., 18 and 20) are in alignment, which allows an operator to grip the handle through these apertures. A center actuator 22 is interposed between the front housing 6 and rear housing 8 and extends into both the front housing aperture 18 and rear housing aperture 20. A means for controlling the supply of electricity to the motor, preferably a switch 66, is also encased within the housing 4. A means for supplying the flow of electricity to the switch 66, such as a pigtail-type connector 24, is mounted on the rear housing 8.

The front housing 6 and rear housing 8 are preferably each a single piece construction of die cast metal. A front cover 26 encases the left arm 10 and right arm 14 of the front housing 6. Similarly, the left arm 16 and right arm 12 of the rear housing 8 are encased by an identically-shaped rear cover 28. The purpose of the front cover 26 and rear cover 28 is to provide an insulating shell over the handle 2 and related components in order to protect an operator from an electrical-related injury. In one embodiment, the front cover 26 and rear cover 28 are made out of rubber, although other insulating materials are within the spirit of the invention. Regardless of the insulating material, it is preferable to construct the front cover 26 and rear cover 28 with dimples protruding therefrom, which provide additional surface area for an operator to grip, thereby reducing the chance of slippage.

In one embodiment, the left arms and right arms of the front housing 6 and rear housing 8 are angled upward toward the operator (see FIG. 2). It is preferable for the angle to vary between zero and forty-five degrees, which gives an operator more leverage in directing the machine.

In one embodiment, as shown in FIG. 2, the handle 2 has three actuating means—a left actuator 30, a right actuator 32, and a center actuator 22—which are interposed between the front housing 6 and rear housing 8 (see FIG. 1 for interconnection of actuators and housings). The left actuator 30 extends from the bottom of the left arm of the rear housing 16 and the right actuator 32 extends from the bottom of the right arm of the rear housing 12. The left actuator 30, right actuator 32, and center actuator 22 each have a first position of use and a second position of use. In the first position of use, each actuator is biased toward the floor and has not been depressed by an operator; consequently, the floor machine is not in operation. In the second position of use, the actuator has been depressed by the operator, thereby causing the machine to operate.

Figure 3:
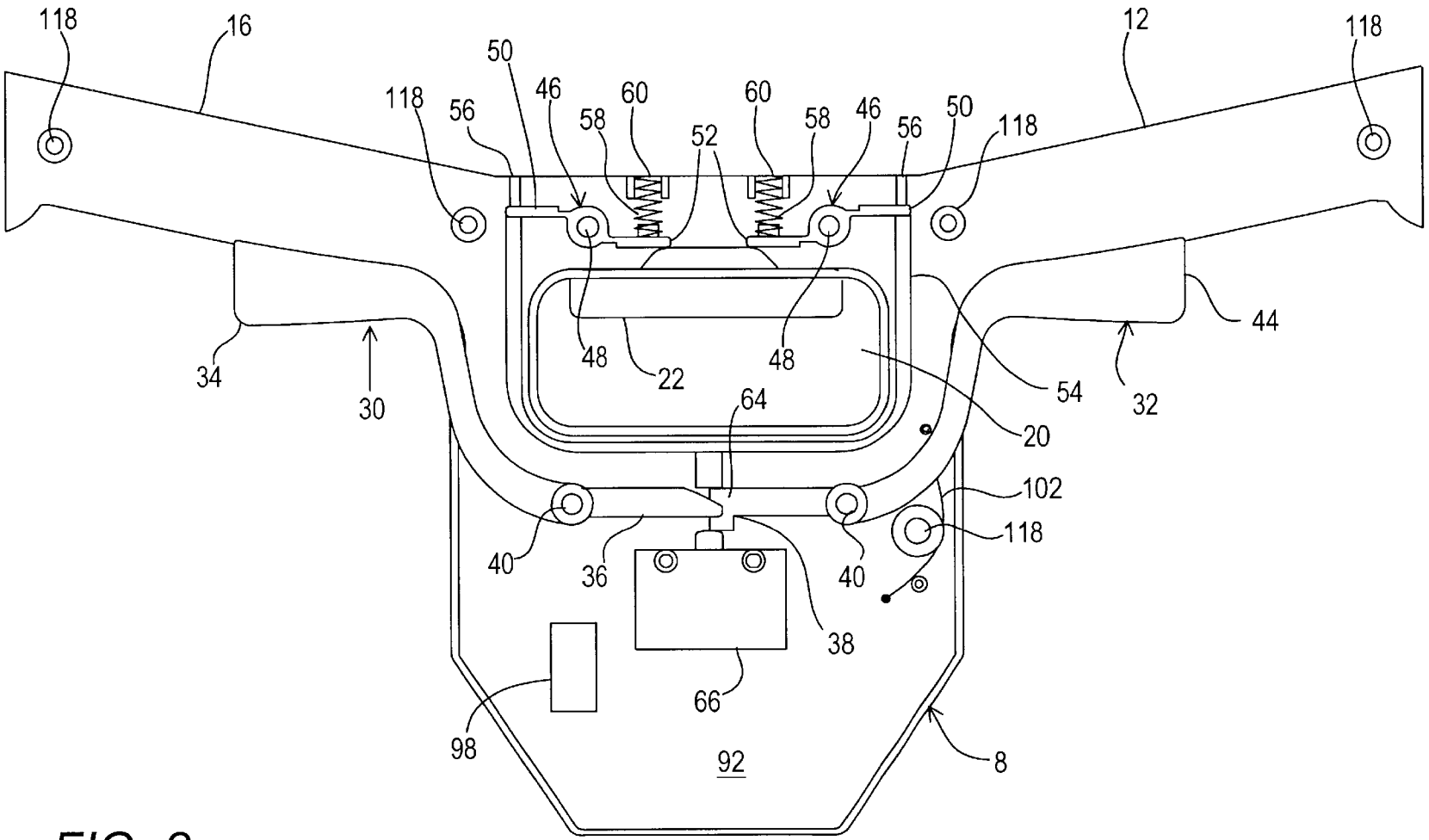
FIG. 3 is a front perspective view of the front side of the rear housing of the handle with the left, right, and center actuators in first positions of use.

The left actuator 30 is preferably made out of plastic, although other resilient materials are also within the spirit of the invention. As shown in FIG. 3, the left actuator 30 has a first end 34 and a second end 36. The first end of the left actuator 34 is generally triangular in shape and is interposed between the left arm of the rear housing 16 and the right arm of the front housing 14. The second end of the left actuator 36 is interconnected to the second end of the right actuator 38. The left actuator 30 is mounted on a pivot stand 40 emanating from the rear housing 8 and secured to the pivot stand 40 with a pin 42 (shown in FIG. 1).

The right actuator 32 is also preferably made out of plastic, although other resilient materials are also within the spirit of the invention. Also shown in FIG. 3, the right actuator 32 has a first end 44 and second end 38. The first end of the right actuator 44 is generally triangular in shape and is interposed between the right arm of the rear housing 12 and the left arm of the front housing 10. The right actuator 32 is mounted on a pivot stand 40 emanating from the rear housing 8 and secured to the pivot stand 40 with a pin 42 (shown in FIG. 1). In one embodiment, the second end of the right actuator 38 is notched so it can receive a pointed second end of the left actuator 36.

Figure 7:
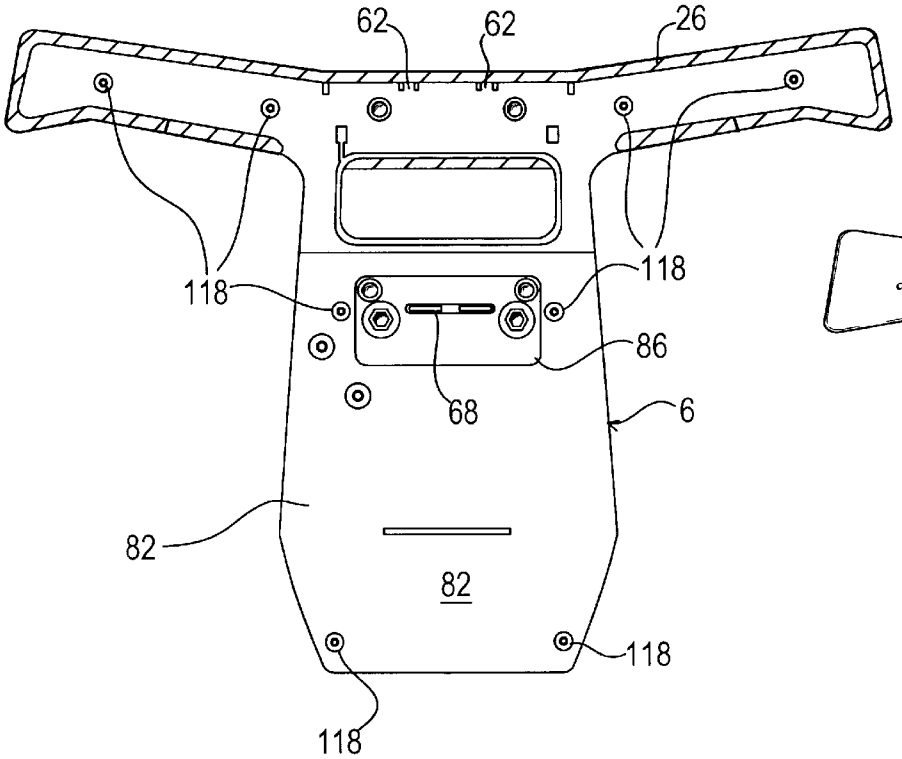
FIG. 7 is a front perspective view of the rear side of the front housing without any actuators in place, but with the safety lock.
Figure 10:
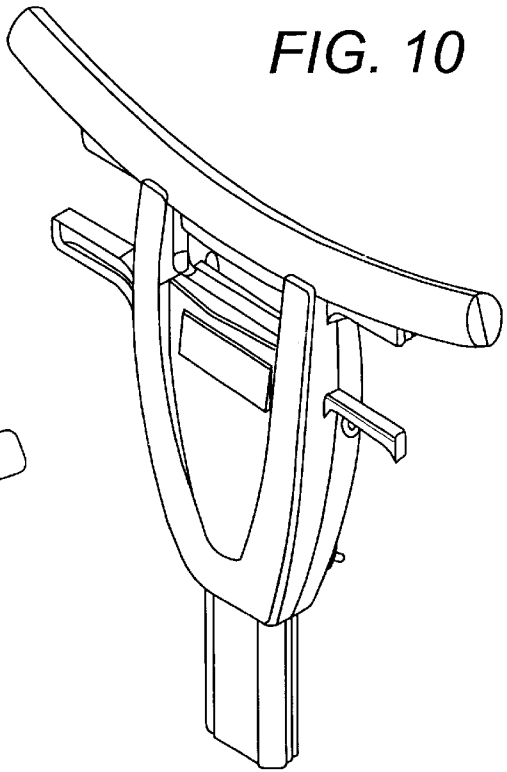
FIG. 10 is an isometric perspective view of the handle shown in FIG. 9.
Figure 9:
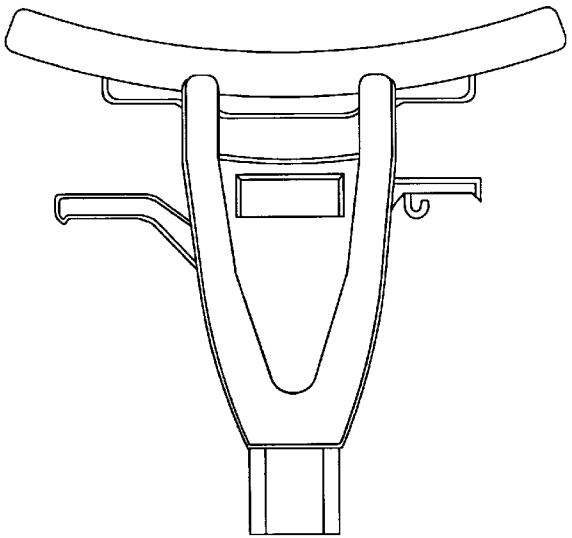
FIG. 9 is a front perspective view of an additional embodiment of the handle.
Figure 11:
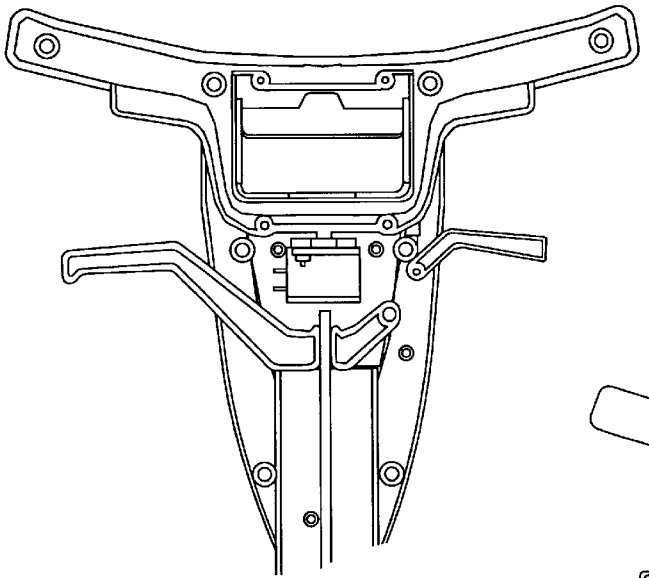
FIG. 11 is a front perspective view of the front side of the rear housing of an additional embodiment of the handle.

As further shown in FIG. 3, a center actuator 22 extends into the aperture, in the rear housing 20 and is centered beneath the left arm of the rear housing 16 and right arm of the rear housing 12. The preferred embodiment of the center actuator 22 is a solid bail. In order to minimize cost, it is preferable to make the center actuator 22 out of plastic, but other resilient materials are also within the scope of the invention. In the first position of use, the center actuator 22 is seated upon two trans-bails 46, which are each seated on a pivot stand 48 of the rear housing 8. Each trans-bail 46 has a first end 50 and a second end 52. The first end 50 of each trans-bail 46 is interconnected to a U-shaped trans-bail 54 and is seated on a corresponding trans-bail stand 56 protruding from the rear housing 8. The second end 52 of each trans-bail 46 is interconnected to a spring 58. Each spring 58 keeps the second end 52 of the respective trans-bails 46 in a biased position against the center actuator 22. Each spring 58 is seated in a spring receiver 60. Each spring receiver 60 is comprised of two parallel protrusions from the rear housing 8, which together create a slot 62 (see FIG. 7) to accept each spring 58. The U-shaped trans-bail 54 has a cylindrical protrusion emanating toward the floor from its middle, which is seated at the point 64 where the second end of the left actuator 36 and the second end of the right actuator 38 are interconnected.

Figure 4:
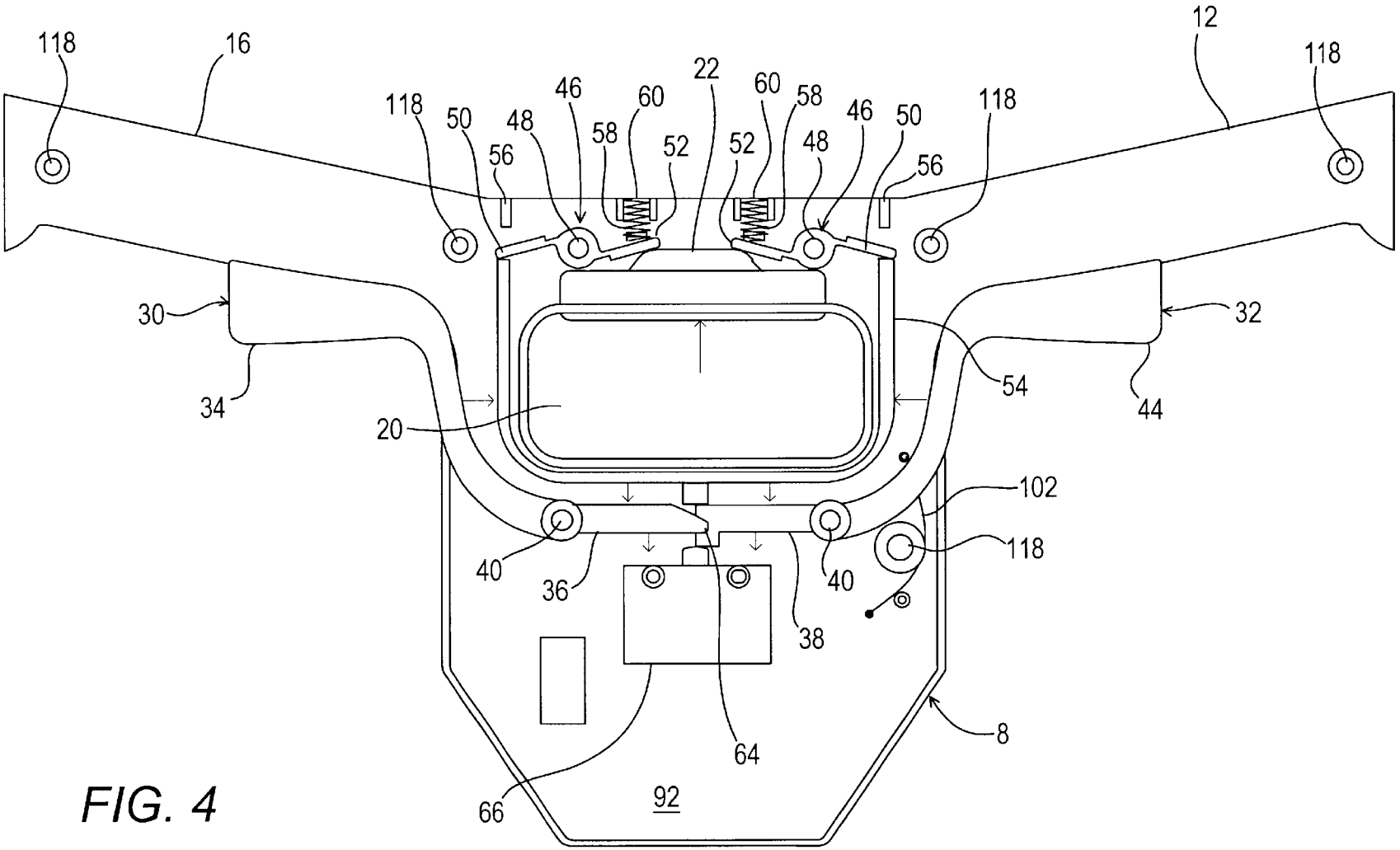
FIG. 4 is a front perspective view of the front side of the rear housing of the handle with the left, right, and center actuators in second positions of use.

FIG. 4 shows the center actuator 22 in its second position of use, whereby the floor polishing machine is operational. When depressed, the center actuator 22 pushes the second ends 52 of the two trans-bails 46, which, in turn, each compress a respective spring 58. Simultaneously, the first ends 50 of the two trans-bails 46 rotate about each pivot stand 48 and apply force to the U-shaped trans-bail 54. The result is that the cylindrical protrusion on the U-shaped trans-bail 54 applies force to the second end of the right actuator 38, which, in turn, depresses a switch 66 that activates the machine.

When the center actuator 22 is released, the compressed springs 58 recoil and apply force to the second ends 52 of the two trans-bails 46, which push the center actuator 22 back to its first position of use. As a result, the first end of each trans-bail 50 rotates in the opposite direction from when the center actuator 22 was depressed and releases the force applied to the U-shaped trans-bail 54. Thus, the U-shaped trans-bail 54 releases the force on the second end of the right actuator 38, thereby releasing the switch 66. The U-shape trans-bail 54, and the left actuator 30 and right actuator 32 move away from the switch 66, thereby shutting off the machine.

Since the left actuator 30 and right actuator 32 are interconnected and thus, move in unison, an operator need only depress one or both actuators to activate the machine. Consequently, when the left actuator 30 is depressed, it rotates in a clockwise manner about its pivot stand 40 and the right actuator 32 corresponding rotates in a counter-clockwise manner about its pivot stand 40. As a result, the second end of the left actuator 36 depresses the second end of the right actuator 38, thereby depressing the switch 66 and activating the machine.

For safety reasons, the center actuator 22 must be continuously held in a depressed position in order for the polisher to operate. This way, the machine cannot be rotating without the operator's knowledge. In order to ensure that the center actuator 22 is not inadvertently activated by the operator, a safety lock 68 is integrated into the front housing 6 (see FIG. 1). The safety lock 68 has a first position of use and a second position of use. In FIG. 2, the safety lock 68 is shown in the first position of use, which prohibits the operator from engaging the switch 66 with either the left actuator 30, right actuator 32, or center actuator 22. In the second position of use, the operator can engage the switch 66 by depressing and holding the left actuator 30, right actuator 32, or center actuator 22.

Figure 6:
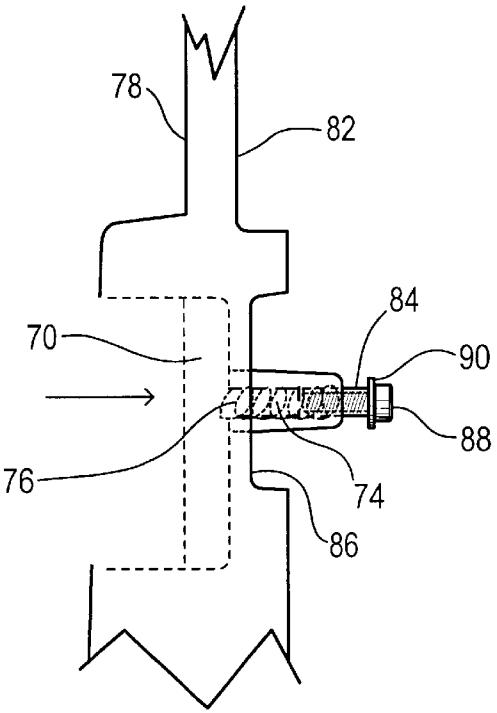
FIG. 6 is a cut-away side perspective view of the front housing with the safety lock in its second position of use.
Figure 5:
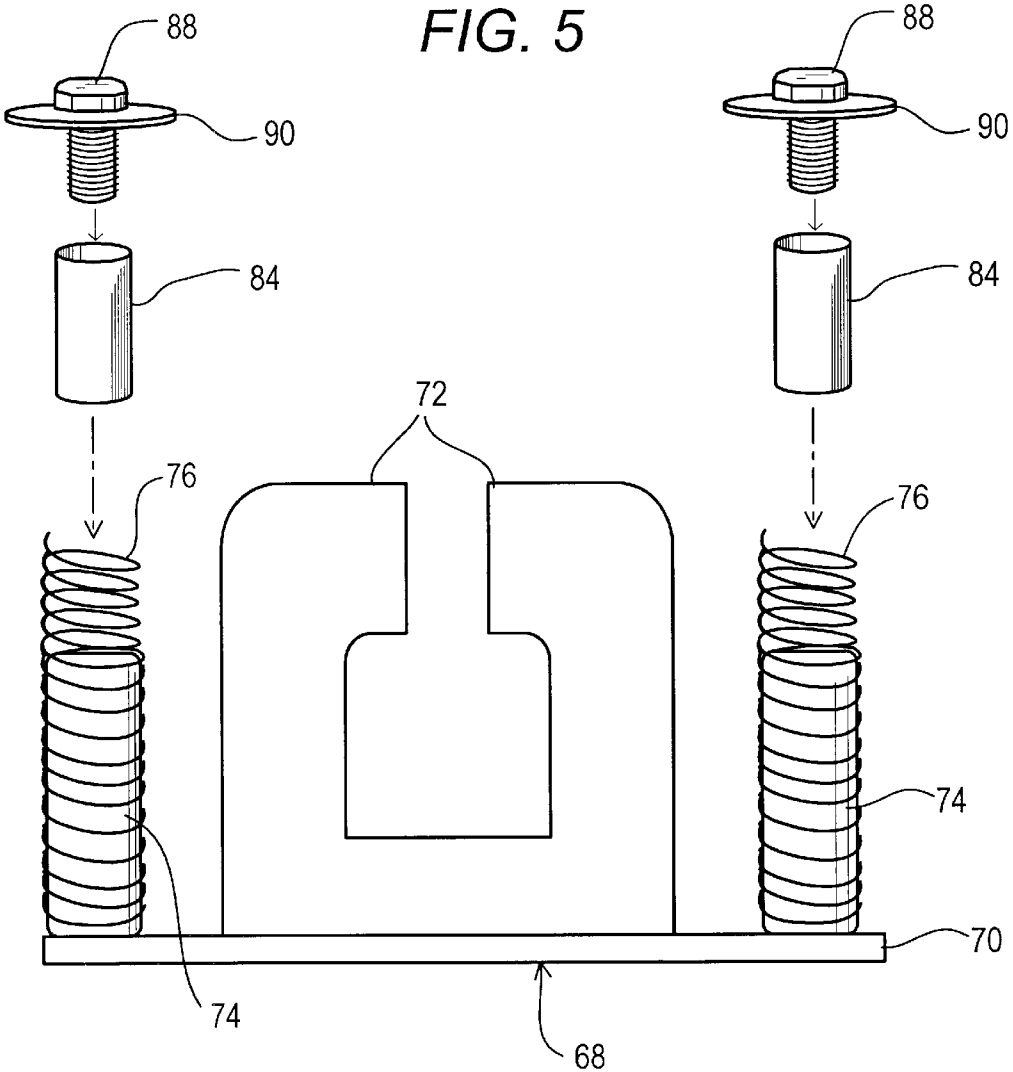
FIG. 5 is a top perspective view of the safety lock and interconnecting components.

As shown in FIG. 5, the preferable embodiment of the safety lock 68 is a face plate 70, which in one embodiment is rectangular although other polygons, such as a square or octagon would work as well. Attached to the face plate 70 are two parallely mounted inverted L-shaped protrusions 72 and two cylindrical receiving tubes 74. A spring 76 is seated on each cylindrical receiving tube 74. As shown in FIG. 1, the front side of the front housing 78 has a safety lock depression 80 for receiving the safety lock 68. As shown in FIGS. 5 and 6, the safety lock 68 is inserted into the safety lock depression 80 whereby the springs 76 are positioned between face plate 70 of the safety lock 68 and the front side of the front housing 78. In this configuration, the cylindrical receiving tubes 74 are accessible from the rear of the front housing 82. From the rear side of the front housing 82, a tube 84 is inserted into the rear of the safety lock depression 86. The tube 84 aligns a bolt 88, which is fastened to the cylindrical receiving tube 74 of the safety lock 68. The bolt 88 is inserted through a washer 90 for stabilization and is inserted into each respective tube 84 and secured into each cylindrical receiving tube 74 of the safety lock 68.

As previously noted, in the first position of use, the safety lock 68 prohibits the operator from engaging the switch 66. The inverted L-shaped protrusions 72 of the safety lock 68 are positioned between the second end of the right actuator 38 and the switch 66. Consequently, if an operator depresses the left actuator 30 or right actuator 32, the second end of the right actuator 38 will make contact with the inverted L-shaped protrusions 72 of the safety lock 68, thereby prohibiting any further movement.

When an operator desires to engage the switch 66, he must first depress the safety lock 68 toward the front side of the front housing 78 into its second position of use. In this position, as shown in FIG. 6, the inverted L-shaped protrusions 72 move away from the rear side of the front housing 82 and no longer block the second end of the right actuator 38 from engaging the switch 66. Thus, to operate the machine, a person must first depress the safety lock 68 and then continuously depress either the left actuator 30, right actuator 32, or center actuator 22 for the floor polisher to remain engaged. Once any of these actuators are released, the switch 66 becomes disengaged and the machine turns off. This arrangement assures that the floor polisher is not operated without the supervision of an operator.

Additional embodiments of the present invention have been considered by the inventor. For example, in one embodiment, the handle 2 is further comprised of a solution dispensing lever 94 (shown in FIG. 1), which is mounted on the front of the rear housing 92 by a pin 95 and encased by the housing 4. The solution dispensing lever 94 rotates about the pin 42 and has been adapted for use with a solution dispensing mechanism. In another embodiment, the handle 2 has a height adjustment lever 96 (also shown in FIG. 1), which is mounted on the front of the rear housing 92 by a pin 97 and encased by the housing 4. The height adjustment lever 96 allows the operator to vary the distance between the handle 2 and the floor, thereby accommodating operators of different heights. Both the height adjustment lever 96 and solution dispensing lever 94 are positioned in housing 4 so that the operator can easily access them by taking his hand off of the handle.

Figure 8:
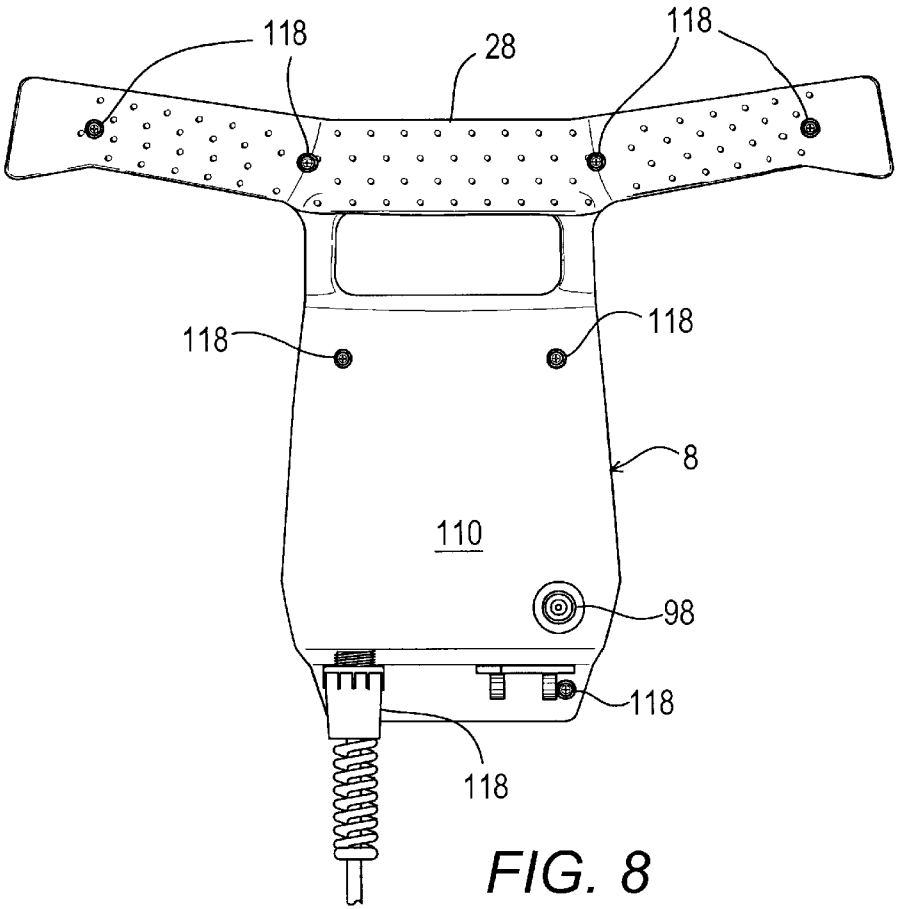
FIG. 8 is a front perspective view of the rear side of the rear housing without any actuators in place, but with a pigtail connector and a circuit breaker.

In order to protect the floor polishing machine and its operator from electricity surges, it is preferable for the handle 2 to have a circuit breaker 98 (see FIG. 8), which is mounted on the rear side of the rear housing 110. The circuit breaker 98 has a first and second position of use and is interconnected to the switch 66. In first position of use, electricity flows through the circuit breaker 98 to the switch 66. When the overflow of electricity occurs, the circuit breaker 98 moves into a second position of use in which it prevents electricity from flowing to the switch 66. In the second position of use, the circuit breaker 98 must be reset by the operator before electricity will flow to the switch 66 again.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A T-shaped handle for a floor polisher, burnisher or like machine having an electric motor, comprising:

(a) a means for controlling a supply of electricity to the motor; and (b) a first means for actuating the means for controlling the supply of electricity to the motor located between a second means and a third means for actuating the means for controlling the supply of electricity to the motor, wherein the first actuating means is centrally mounted on the T-shaped handle.

2. The apparatus as in claim 1, further comprising a means for adjusting the height of the handle in relation to the floor, wherein the height adjustment means is mounted on the T-shaped handle.

3. The apparatus as in claim 2, wherein the height adjustment means includes a lever.

4. The apparatus as in claim 1, further comprising a means for dispensing cleaning solution, wherein the dispensing means is mounted on the T-shaped handle.

5. The apparatus as in claim 4, wherein the dispensing means includes a lever.

6. The apparatus as in claim 1, further comprising a means for preventing the first actuating means, second actuating means, and third actuating means from actuating the means for controlling the supply of electricity to the motor.

7. The apparatus as in claim 6, wherein the means for preventing the first actuating means, second actuating means, and third actuating means from actuating the means for controlling the supply of electricity to the motor includes a safety lock.

8. The apparatus as in claim 1, further comprising a means for suspending the flow of electricity to the motor in the event of an electrical overload, wherein the suspension means is mounted on the T-shaped handle.

9. The apparatus in claim 8, wherein the means for suspending the flow of electricity to the motor in the event of an electrical overload includes a circuit breaker.

10. The apparatus in claim 1, wherein the means for controlling the supply of electricity to the motor includes a switch.

11. The apparatus in claim 1, wherein the first means for actuating the means for controlling the supply of electricity to the motor includes an actuator bail.

12. The apparatus in claim 1, wherein the second means and third means for actuating the means for controlling the supply of electricity to the motor each includes an actuator lever.

13. A handle for a floor polisher, burnisher or like machine having an electric motor, comprising:

(a) a T-shaped handle;

(b) a centrally-mounted motor actuator positioned between two separate and independent motor actuators, wherein the centrally-mounted actuator is operable by an operator holding the T-shaped handle, and (c) a switch for controlling electricity to the motor, wherein the switch is mounted on the T-shaped handle.

14. The apparatus as in claim 13, further comprising a release mechanism for dispensing cleaning solution, wherein the release mechanism is mounted on the T-shaped handle.

15. The apparatus as in claim 13, further comprising a height adjustment mechanism for varying the distance between the T-shaped handle and a floor, wherein the height adjustment mechanism is mounted on the T-shaped handle.

16. The apparatus as in claim 13, further comprising a circuit breaker to control the flow of electricity to the switch.

17. The apparatus as in claim 13, further comprising an electrical cord for supplying electricity to the motor, wherein the electrical cord is mounted on the T-shaped handle.

18. A handle for a floor polisher, burnisher or like machine having an electric motor, comprising:

(a) a substantially T-shaped front housing having a left arm and a right arm, wherein the front housing has a first aperture centrally located along a longitudinal axis of the front housing and beneath the left arm and the right arm to allow an operator to grip the front housing;

(b) a substantially T-shaped rear housing having a left arm and a right arm, wherein the rear housing is fastened to the front housing by a plurality of fasteners and has a second aperture centrally located along a longitudinal axis of the rear housing for alignment with the first aperture of the front housing;

(c) a central bail mechanism interposed between the front housing and the rear housing, wherein the central bail mechanism partially projects into the first aperture;

(d) a U-shaped trans bail interposed between the front housing and the rear housing for effectuating the activation of the motor, wherein the U-shaped trans bail partially surrounds the first aperture; and (e) an electrical switch for actuating the motor, wherein the switch is adjacent to either the front housing or the rear housing.

19. The apparatus as in claim 18, further comprising a dispensing lever for cleaning solution, wherein the lever is encased by the front housing and the rear housing.

20. The apparatus as in claim 18, further comprising a height adjustment lever for adjusting distance between the handle and a floor, wherein the height adjustment lever is interposed between and partially protruding from the front housing and rear housing.

21. The apparatus as in claim 18, further comprising a safety locking mechanism centrally mounted on the front housing.

22. The apparatus as in claim 18, further comprising an electrical power cord, wherein the cord is a pigtail connector and is mounted to the rear housing.

23. The apparatus as in claim 18, further comprising a circuit breaker device interposed between a power cord and the electrical switch, and encased by the front housing and rear housing.

24. The apparatus as in claim 18, further comprising an insulating cover, wherein the cover encases the left arm and right arm of the front housing and rear housing.

* * * * *